US005782658A

United States Patent [19]

Maegawa et al.

[11] Patent Number: 5,782,658

[45] Date of Patent: *Jul. 21, 1998

[54] TUBULAR SUPPORTING STRUCTURE

[75] Inventors: Akihito Maegawa; Nobuyoshi Tanaka; Yukinori Saka; Kiyofumi Ichida, all of Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 638,208

[22] Filed: Apr. 26, 1996

[30] Foreign Application Priority Data

Apr. 26, 1995 [JP] Japan ..... 7-127218

[51] Int. Cl.[6] ..... H01R 13/422

[52] U.S. Cl. ..... 439/595; 439/271; 439/752

[58] Field of Search ..... 439/595, 271, 439/752

[56] References Cited

U.S. PATENT DOCUMENTS

| | | | |
|---|---|---|---|
| 3,474,398 | 10/1969 | Piorruneck . | |
| 4,944,695 | 7/1990 | Tsuji et al. | 439/595 |
| 5,163,848 | 11/1992 | Maeda et al. | 439/489 |
| 5,192,225 | 3/1993 | Suzuki | 439/489 |
| 5,575,684 | 11/1996 | Uchida et al. | 439/595 |

FOREIGN PATENT DOCUMENTS

| | | |
|---|---|---|
| 0 420 255 | 4/1991 | European Pat. Off. . |
| 5-65996 | 9/1993 | Japan . |
| 2071927 | 9/1981 | United Kingdom . |
| 2164505 | 3/1986 | United Kingdom . |

*Primary Examiner*—Gary F. Paumen

*Attorney, Agent, or Firm*—Banner & Witcoff, Ltd.

[57] ABSTRACT

A tubular cap-like retainer 20 fits within a supporting structure 10 and has a side wall 22 with a pair of slits 23 formed in a parallel manner to define a flexible arm 24. Both ends of the arm 23 are attached to the retainer 20. A locking projection 25 formed on the inner face of the arm engages a cavity member 11 within the structure 10 thus urging the arm against the inner surface of the structure 10 with a strong retention force.

11 Claims, 3 Drawing Sheets

TUBULAR SUPPORTING STRUCTURE

FIELD OF INDUSTRIAL APPLICATION

The present invention relates to a tubular supporting structure, and particularly to such a structure for an electrical connector.

PRIOR ART

As shown in accompanying FIGS. 3*a*–3*c*, a conventional retainer for a water-proof electrical connector is well-known as a tubular supporting structure. A cap-like retainer 1 is covered by the outer part of a housing 10 having terminal fitting insertion chambers 7, and doubly stops terminal fittings housed in the terminal fitting insertion chambers. The retainer 1 has an outer end wall 2 that faces out of the housing, and a surrounding side wall 3. Pairs of slits 4 are formed in a parallel manner on the side wall 3 as illustrated. The slits 4 extend from the inner side towards the outer side. Arms 5 are formed between the slits 4 and each has a free end. On the inner face of the arm 5 is formed a projection 6 that extends inwardly. A seal 13 is provided inboard of the retainer.

When the retainer 1 is pushed into a housing (FIG. 3*c*), the projections 6 formed on the inner side faces of the arms 5 make contact with an inner part of the housing. As a result, the arms 5 are resiliently bent outwardly until the cap 1 is at a specified depth where the projections 6 fit with corresponding recesses 9 of the housing (FIG. 3*b*). In this condition the arms 5 are loaded so that the cap 1 is supported in the housing.

In the conventional tubular supporting structure described above, the supporting force is weak since the arms 5 have free ends.

The present invention has been developed after taking this problem into consideration, and aims at presenting a tubular supporting structure that can strengthen the supporting force and that can also make it robust.

SUMMARY OF THE INVENTION

According to the invention there is provided a tubular retainer and a support structure in combination, the retainer fitting with the support structure along a fitting axis, having a protruding wall and in the wall a flexible arm defined by spaced slits, the arm having a projection perpendicular to said axis and adapted for engagement with said support structure in use, wherein said flexible arm is secured at both ends thereof to said wall.

Since the arm is formed so as to be supported at both ends between the slits it is much stronger than the prior art construction. The arm is stiffer and the supporting force is thus increased. The arm is also less susceptible to damage since a free end is not provided.

BRIEF DESCRIPTION OF THE DRAWINGS

Other features of the invention will be apparent from the following description of a preferred embodiment shown by way of example only in the accompanying drawings in which.

DESCRIPTION OF PREFERRED EMBODIMENT

Figure 1:
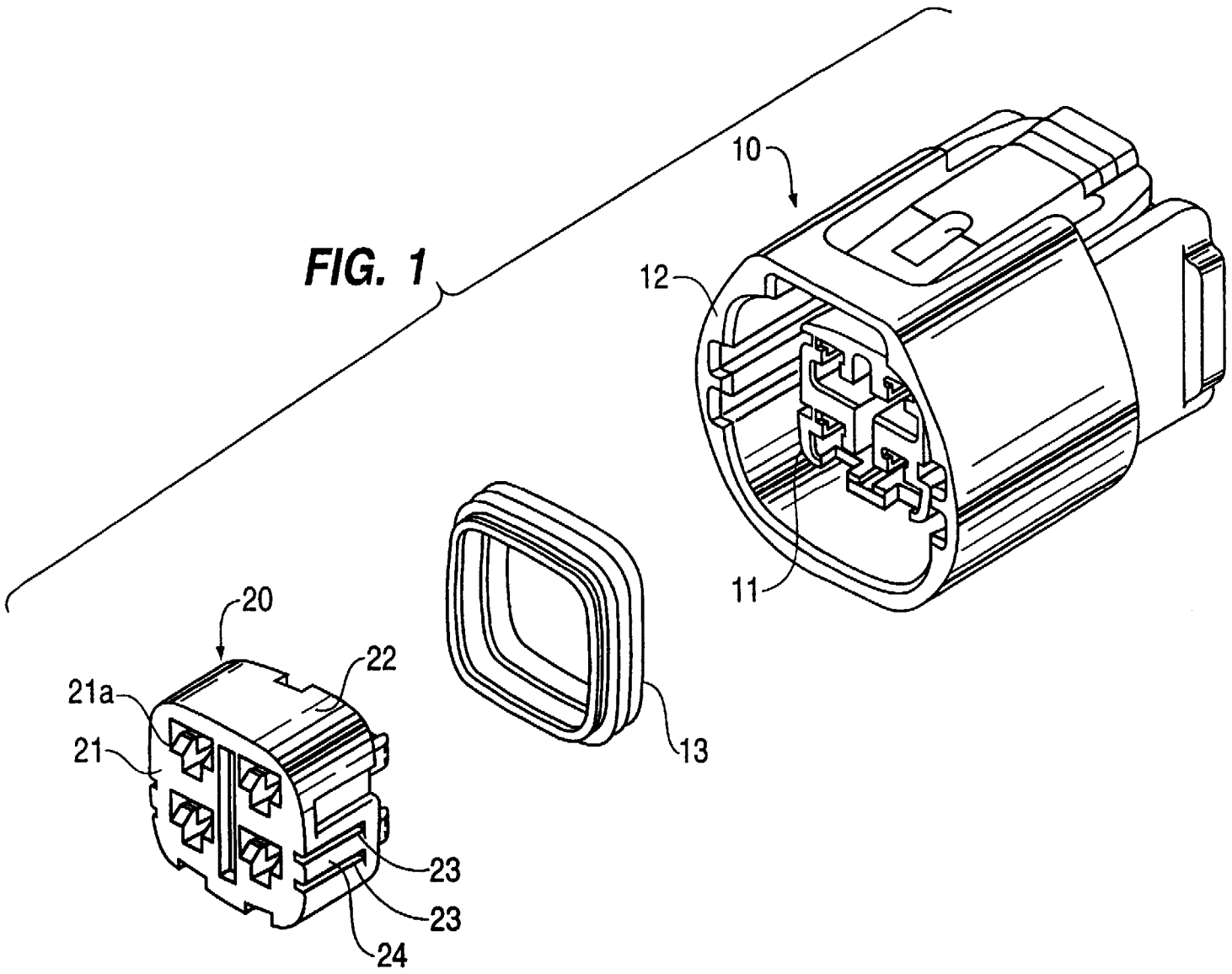
FIG. 1 is an exploded isometric view of a water-proof connector using a tubular supporting structure according to an embodiment of the present invention.
Figure 2A:
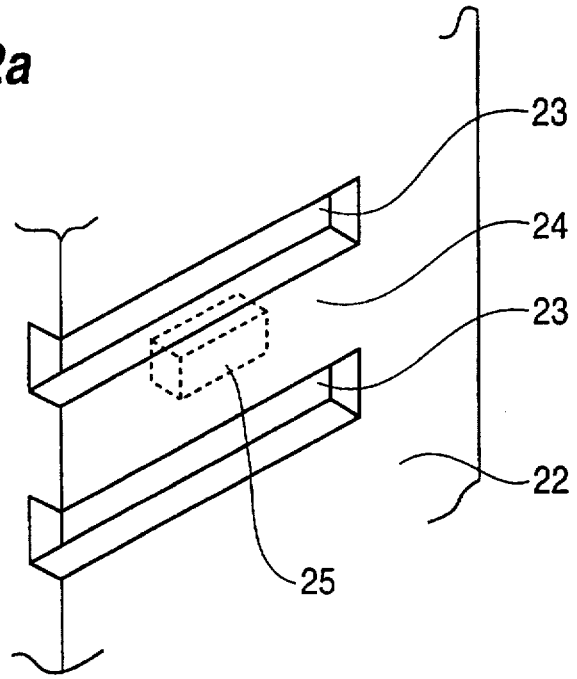
FIG. 2*a* is an enlarged isometric view of the essential part of the invention.

With reference to FIGS. 1 and 2*a*, a water-proof connector housing 10 comprises a substantial tubular cavity member 11 having terminal fitting insertion chambers which allow terminal fittings to be housed therein, and a tubular hood member 12 that covers this cavity member 11. The cavity member 11 and the hood member 12 are connected towards the inner end so as to define a peripheral clearance around the cavity member, and an annular rubber seal 13 is attachable to the exterior side face of the inner extremity of the cavity member 11.

A cap-like retainer 20 is arranged to be able to cover the extreme end of the cavity member 11. On an outer face 21 are formed a plurality of through holes 21*a* which correspond to each of the terminal fitting insertion chambers of the cavity member 11. Further, a tubular side wall 22 is formed that extends from the edges of the outer face 21 towards the inner side. The outer end of the cavity member 11 is insertable within the side wall 22.

As shown in the enlarged view of FIG. 2, the side wall 22 has slits 23 formed therein that extend towards the inner end. The slits 23 are formed in pairs on the side wall 22 and their extreme inner ends are closed. An arm 24 is formed between the slits 23 and which is fixed at both ends to the side face wall 22. A locking projection 25 is formed on the inner face of the arm 24 and which projects towards the cavity member 11 in use. Furthermore, on the side face of the cavity member 11 is formed an aperture 26 corresponding to the locking projection 25.

Since the arm 24 is supported from both sides, only the central portion can bend inwards and outwards. As a result, compared to the conventional case where one extremity is free, a firm arm is achieved. Moreover, the rigidity of the arm 24 can be altered by changing the thickness and width of the arm 24.

In the present embodiment, the retainer 20 has an outer wall 21 and is cap-like. However, it need not necessarily be cap-like as long as the arm 24, which can bend inwards and outwards, is formed on the side wall 22 for engagement with the cavity member 11.

Figure 2B:
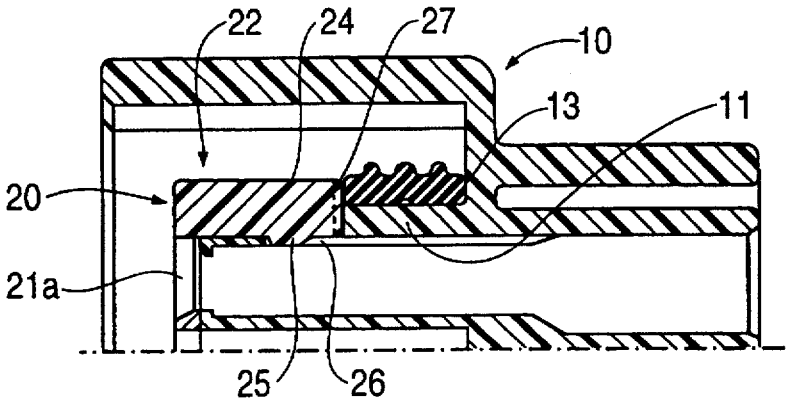
FIG. 2*b* is a partial section through a connector and showing one embodiment of the invention in the fully engaged state.
Figure 2C:
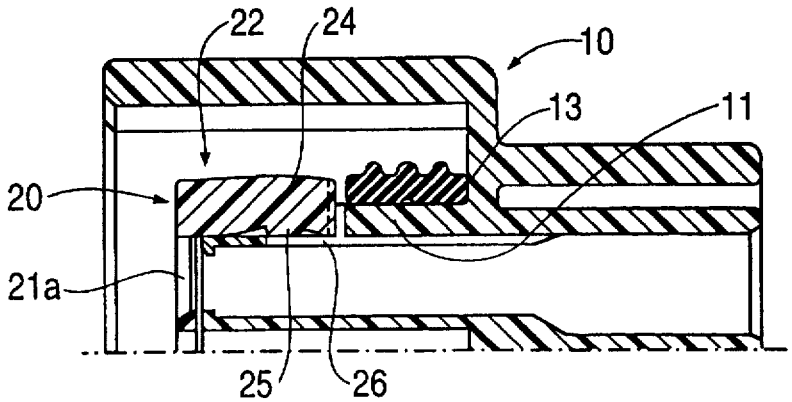
FIG. 2*c* corresponds to FIG. 2*b* and illustrates a partially engaged state.
Figure 3A:
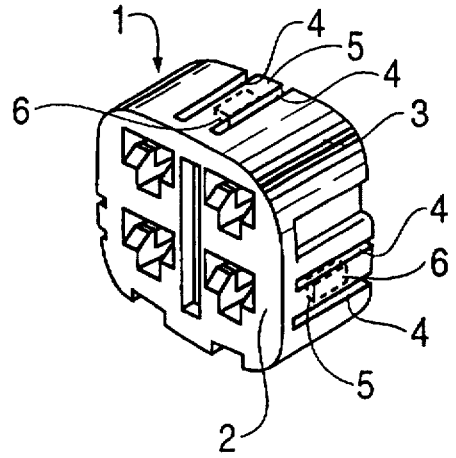
FIG. 3a (PRIOR ART)
FIG. 3*a* is an exploded isometric view of a prior art water-proof connector.
Figure 3B:
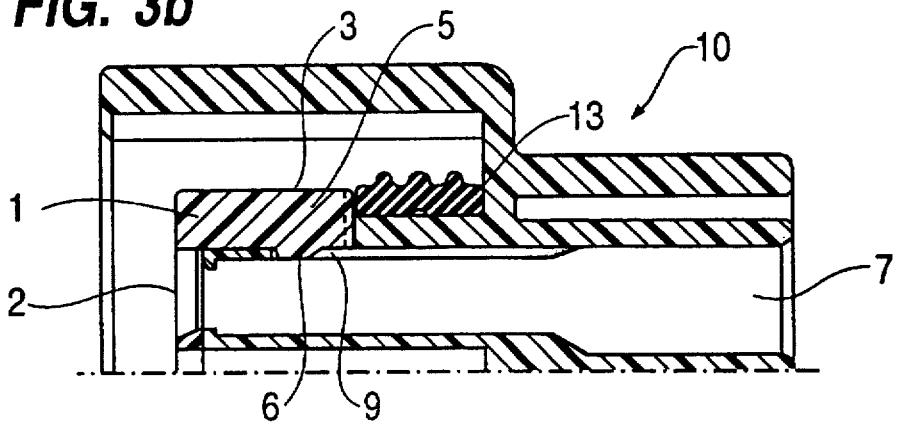
FIG. 3*b* corresponds to FIG. 2*a* and shows a prior art arrangement.
Figure 3C:
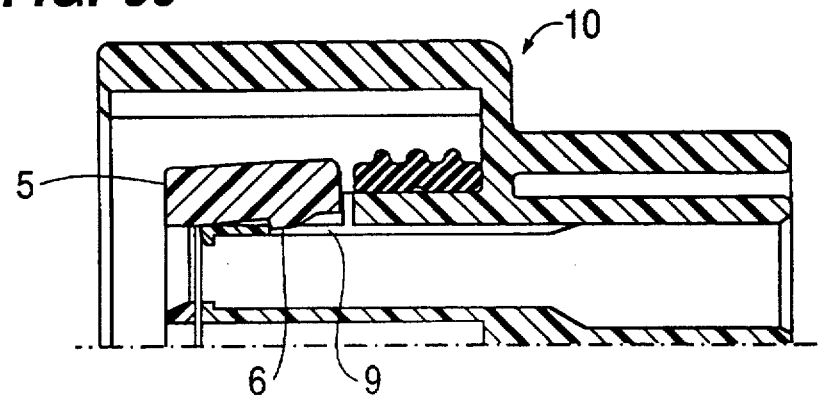
FIG. 3*c* corresponds to FIG. 2*c* and shows a prior art arrangement.

FIGS. 2*b* and 2*c* illustrate engagement of a retainer on a cavity member 11. FIG. 2*b* shows the fully engaged condition, the linking portion at the free end of arm 24 being indicated by dotted line 27. FIG. 2*c* illustrates how the mid portion of the arm 24 is urged outwardly as the retainer is engaged, and demonstrates that the engagement force is increased due to the increased stiffness.

The operation of the present embodiment, configured as described above, is explained.

Terminal fittings are inserted into the terminal fitting insertion chambers of the cavity member 11, and the rubber seal 13 is fitted in the outer portion. The retainer 20 is inserted into the hood member 12, and the cavity member 11 makes con tact with the locking projection 25 located on the inner side of the arm 24. Accordingly, the outer side of the cavity member 11 tries to push out the arm 24 via the locking projection 25.

As described above, since the arm 24 is supported from both ends, only the central portion tends to extend outwards (FIG. 2*c*), the locking projection 25 being continuously pushed from the inside with a strong force. Furthermore, when the retainer 20 is pushed in, the locking projection 25 fits into the aperture 26 and the retainer 20 comes to a halt.

In this position, the arm 24 pushes the locking projection 25 towards the opening 26 with a strong force, and the supporting force is accordingly increased compared with the prior art. Moreover, since the arm 24 is supported from both ends, there is no possibility of damage as can happen in the case where one end is free, such damage occurring due to some object striking the free end, and possibly breaking off the arm. Strengthening is thereby effected.

Although the invention has been described with the locking projection directed inwardly, it might also be directed outwardly for engagement of a retainer within a corresponding structure. What is important is that the locking arm is supported at both ends to increase the stiffness thereof, and project the arm from inadvertent damage.

We claim:

1. In combination a tubular retainer and a water-proof connector housing having a cavity member adapted to receive at least one terminal fitting therein and a seal, the retainer fitting onto the cavity member along a fitting axis to retain the seal, said retainer having a peripheral wall extending along the fitting axis with a pair of opposite wall portions, said wall portions each having an inner end facing said seal and an opposite outer end, each said wall portion having spaced slits defining a flexible arm secured at both ends thereof to the wall between the slits to stiffen the arm, said slits being open at said outer ends and closed at the inner ends, and each flexible arm having a projection extending perpendicular to said axis and adapted for secure engagement in a lock opening defined in said cavity member.

2. The combination of claim 1 wherein the retainer fits within the connector housing.

3. The combination of claim 2 wherein said projection is directed inwardly of the inner side of the flexible arm.

4. The combination of claim 1 wherein said flexible arm has parallel sides.

5. The combination of claim 1 wherein said projection is at the middle of said arm.

6. The combination of claim 1 wherein the long axis of said flexible arm is parallel to the insertion direction of said retainer.

7. The combination of claim 1 wherein said retainer is substantially rectangular and said wall is of substantially constant thickness, the end faces of the retainer being planar and the adjacent edges of the side walls being radiused, and wherein the cavity member is of complementary shape.

8. The combination of claim 1 wherein said retainer is a one piece plastic molding.

9. The combination of claim 3 wherein the flexible arm has parallel sides and said projection is at the middle of said arm.

10. The combination of claim 7, wherein said retainer and connector housing are molded plastic components.

11. The combination of claim 10 wherein the flexible arms have parallel sides and are symmetrical, each arm having an identical projection at the middle thereof.

* * * * *